US010766053B2

(12) United States Patent
Lee, III

(10) Patent No.: US 10,766,053 B2
(45) Date of Patent: Sep. 8, 2020

(54) MATERIAL DISPENSING SYSTEM AND METHOD

(71) Applicant: Red Devil, Inc., Tulsa, OK (US)

(72) Inventor: George L. Lee, III, Tulsa, OK (US)

(73) Assignee: Red Devil, Inc., Tulsa, OK (US)

( * ) Notice: Subject to any disclaimer, the term of this patent is extended or adjusted under 35 U.S.C. 154(b) by 0 days.

(21) Appl. No.: 16/049,920

(22) Filed: Jul. 31, 2018

(65) Prior Publication Data

US 2018/0333742 A1 Nov. 22, 2018

Related U.S. Application Data

(63) Continuation-in-part of application No. 15/398,193, filed on Jan. 4, 2017.

(51) Int. Cl.
*B05C 17/01* (2006.01)
*B05C 17/005* (2006.01)

(52) U.S. Cl.
CPC .... *B05C 17/0123* (2013.01); *B05C 17/00586* (2013.01); *B05C 17/01* (2013.01); *B05C 17/0103* (2013.01); *B05C 17/00583* (2013.01)

(58) Field of Classification Search
CPC ..... B05C 17/00586; B05C 17/0123; B05C 17/00583; B05C 17/01; B05C 17/0103
See application file for complete search history.

(56) References Cited

U.S. PATENT DOCUMENTS 1,965,271 A 7/1934 Wharton
3,782,598 A * 1/1974 Basa ..... B05C 17/012 222/49
4,615,469 A * 10/1986 Kishi ..... B05C 17/0103 222/327
4,669,636 A 6/1987 Miyata
5,161,715 A 11/1992 Giannuzzi
5,170,911 A 12/1992 Della Riva
5,301,835 A 4/1994 Fulks et al.
5,368,206 A 11/1994 Sandrin
5,556,009 A 9/1996 Motzko
5,704,518 A 1/1998 Vanmoor
5,775,539 A * 7/1998 Bates ..... B05C 17/0103 222/1
5,897,454 A 4/1999 Cannaliato
5,909,830 A 6/1999 Bates et al.
(Continued)

FOREIGN PATENT DOCUMENTS

DE 4215344 A1 * 11/1993 ..... B05C 17/00583
EP 1666786 B1 3/2008

*Primary Examiner* — David P Angwin
*Assistant Examiner* — Bob Zadeh
(74) *Attorney, Agent, or Firm* — David Guerra

(57) ABSTRACT

The present technology is a material dispensing system for controllably dispensing material from a packaging such as a chub pack. The system can include a housing capable of receiving the packaging, at least one nozzle tip including at least one piercing projection capable of piercing the packaging, a piston rod, a motor, and a transmission assembly for converting torque from the motor to a translation output of the piston rod. A ring gear can be operably associated with a planetary gear of the transmission, with a lock block slidingly engageable with the ring gear to prevent it from rotating or to allow the ring gear to rotate freely. A trigger is utilized to control the motor and to operate the lock block.

17 Claims, 9 Drawing Sheets

(56) References Cited

U.S. PATENT DOCUMENTS 6,234,348 B1 5/2001 Okamura et al.
6,338,404 B1 1/2002 Chen
6,564,970 B1 5/2003 Walch et al.
7,249,695 B2 * 7/2007 Shew ..... F16N 11/08 222/258
7,420,341 B2 9/2008 Glasgow et al.
7,637,392 B2 * 12/2009 Hsu ..... B05C 17/0103 222/137
8,387,825 B2 3/2013 Herman et al.
8,424,727 B2 * 4/2013 Herman ..... G01F 11/026 222/105
8,448,825 B2 * 5/2013 Mitrovic ..... B05C 17/0103 222/333
8,528,782 B2 9/2013 Mergener et al.
8,740,021 B2 6/2014 Naughton et al.
8,998,039 B2 4/2015 Kimura et al.
9,039,557 B2 * 5/2015 Naughton ..... B05C 17/0103 221/229
9,045,270 B2 6/2015 Kimura et al.
9,316,352 B2 4/2016 Thorson et al.
9,452,443 B2 9/2016 Grontved et al.
9,511,923 B2 12/2016 Naughton et al.
9,914,148 B2 3/2018 Beckett
2006/0088410 A1 4/2006 Shew
2006/0091032 A1 5/2006 Tsai
2008/0011784 A1 1/2008 Schneider et al.
2008/0023495 A1 1/2008 Takayama et al.
2008/0058863 A1 3/2008 Quintero et al.
2008/0197154 A1 8/2008 Herman et al.
2010/0001017 A1 1/2010 Herman et al.
2010/0006605 A1 1/2010 Sung et al.
2010/0320234 A1 * 12/2010 Punchenko ..... B05C 17/0103 222/196
2011/0068130 A1 3/2011 Mitrovic et al.
2012/0053090 A1 * 3/2012 Tajima ..... B01L 3/0241 506/30
2012/0118917 A1 5/2012 Naughton et al.
2012/0180688 A1 7/2012 Padgett
2012/0267394 A1 * 10/2012 Pierson ..... A61C 9/0026 222/94
2013/0043281 A1 2/2013 Hsu et al.
2015/0076171 A1 * 3/2015 Herman ..... G01F 11/026 222/95
2015/0267679 A1 9/2015 Canal Vila et al.
2017/0008685 A1 * 1/2017 Stever ..... B67D 3/043
2018/0008999 A1 1/2018 Hsu et al.
2018/0185874 A1 * 7/2018 Lee ..... B05C 17/00586
2018/0290165 A1 * 10/2018 Herman ..... B65D 83/0033
2018/0333742 A1 * 11/2018 Lee, III ..... B05C 17/0123

* cited by examiner

MATERIAL DISPENSING SYSTEM AND METHOD

CROSS-REFERENCE TO RELATED APPLICATION

This application is a continuation-in-part under 35 U.S.C. § 120 based upon co-pending U.S. patent application Ser. No. 15/398,193 filed on Jan. 4, 2017, which is incorporated herein by reference in its entirety.

BACKGROUND

Technical Field

The present technology relates to a material dispensing system and method for use in connection with controllably dispensing material from a packaging such as, but not limited to, a chub pack and more specifically to methods and apparatuses related to hand-held caulking guns that can pierce a chub pack.

Background Description

Powered or motorized material dispensing systems are desirable for providing an ergonomic hand-held device controllably dispensing a material with a desired bead size and shape.

Powered hand-held material dispensing devices, such as caulking guns, are known in the art and generally rely on the action of a motor to move a piston to push material out of a prefilled tube. The motion of the piston is induced by the advancement of a piston rod in the direction of the caulk tube, with the piston rod being advanced in the direction of travel by the operator's squeezing of a trigger.

Additionally, manually operated caulking guns are known, whereby the piston is moved by squeezing or grasping a handle of the dispensing tool. The handle is typically connected to a rack by way of a ratchet and pawl-type mechanism to incrementally advance the rack and cause the material to be discharged from a tube or cartridge. These known devices are designed to receive and carry a disposable caulk tube. The housing of these caulking guns and the trigger are generally formed of stamped metal plate for manufacturing economy. The caulk tube generally includes a cylindrical tube featuring a sliding piston, and a nozzle tip, with material stored inside the tube. The caulk tube is commonly more expensive to manufacture than a chub pack because of the different structural elements. While a chub pack is considerably less expensive and easier to manufacture since it is a type of container formed by a tube of flexible packaging material.

SUMMARY OF THE PRESENT TECHNOLOGY

In view of the foregoing disadvantages inherent in the known types of caulking guns now present in the prior art, the present technology provides an improved material dispensing system, and overcomes the above-mentioned disadvantages and drawbacks of the prior art. As such, the general purpose of the present technology, which will be described subsequently in greater detail, is to provide a new and improved material dispensing system and method which has all the advantages of the prior art mentioned heretofore and many novel features that result in a material dispensing system which is not anticipated, rendered obvious, suggested, or even implied by the prior art, either alone or in any combination thereof.

According to one aspect of the present technology, the present technology essentially includes a housing having a configuration capable of receiving a packaging containing a material therein. At least one nozzle tip is associated with the housing. The nozzle tip includes at least one piercing projection having a configuration capable of piercing the packaging and allowing the material in the packaging to be dispensed from the nozzle tip. At least one piston rod is at least partially slidably received in the housing, and has a configuration capable of compressing the packaging toward the piercing projection of the nozzle tip. A transmission assembly selectively operably couples an output of a motor and the piston rod for powered translation of the piston rod in at least one of a forward direction and a reverse direction.

According to another aspect of the present technology, essentially includes a housing having a configuration capable of receiving a packaging containing a material therein. At least one piston rod is at least partially slidably received in the housing, and has a configuration capable of compressing the packaging. At least one planetary gear operably engageable with an output of a motor and with at least one sun gear. The sun gear is selectively and operably coupled with the piston rod for powered translation of the piston rod in at least one of a forward direction and a reverse direction. A ring gear is configured to receive and operably engageable with the planetary gear. A lock block is moveable to operably engage with the ring gear to prevent the ring gear from rotating.

The present technology may also include a piston rod positioning sensing device in operational association with a longitudinal flat first section of the piston rod. There are, of course, additional features of the present technology that will be described hereinafter and which will form the subject matter of the claims attached.

BRIEF DESCRIPTION OF THE DRAWINGS

The present technology will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENTS

Figure 1:
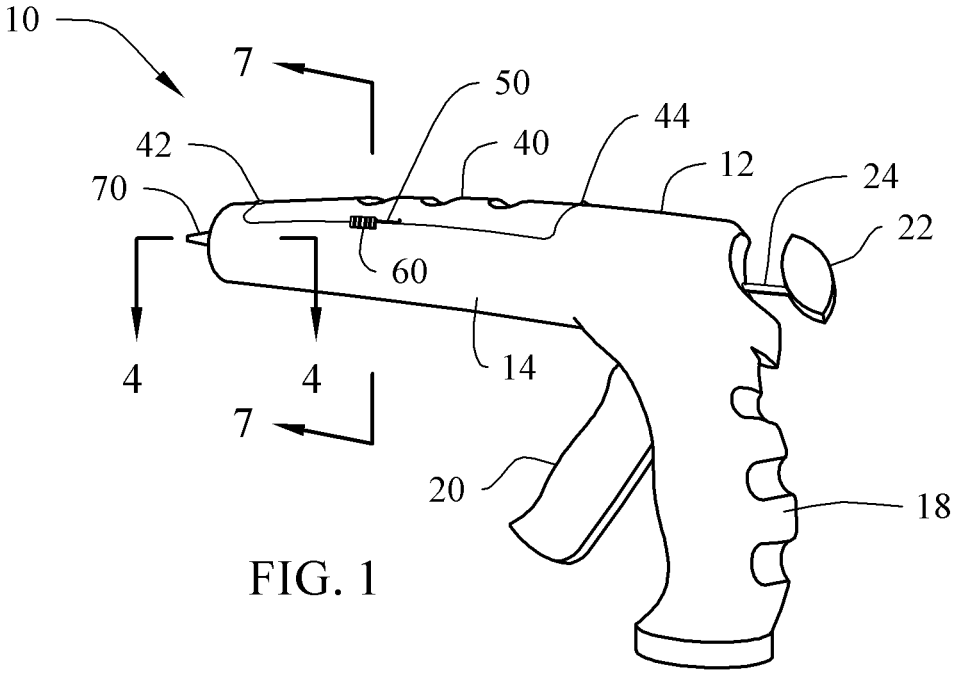
FIG. 1 is a rear-right perspective view of an embodiment of the material dispensing system constructed in accordance with the principles of the present technology, with the phantom lines depicting environmental structure and forming no part of the claimed present technology.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

Known powered caulking guns are essentially designed to receive a caulk tube including a sliding piston and nozzle tip. The nozzle tips are integral with the caulk tube and these are commonly more expensive to manufacture than a chub pack because of the different structural elements. These powered caulking guns further may include complex and less effective means for stopping lateral movement of the piston rod, thereby dispensing unwanted material from the caulk tube.

While the above-described devices fulfill their respective, particular objectives and requirements, the aforementioned patents do not describe a material dispensing system that allows controllably dispensing material from a chub pack.

Therefore, a need exists for a new and improved material dispensing system that can be used for controllably dispensing material from a chub pack. In this regard, the present technology substantially fulfills this need. In this respect, the material dispensing system according to the present technology substantially departs from the conventional concepts and designs of the prior art, and in doing so provide an apparatus primarily developed for the purpose of controllably dispensing material from a chub pack.

Technical features described in this application can be used to construct various embodiments of material dispensing system. A housing can be configured to receive a packaging containing a material to be dispensed. The housing can include a motor and transmission assembly configured for powered translation of a piston rod in at least one of a forward direction and a reverse direction. At least one nozzle tip can be associated with the housing, and can include at least one piercing projection capable of piercing the packaging.

In some embodiments of the aspects of the present technology, the transmission assembly includes at least one planetary gear operably engageable with at least one sun gear. In some embodiments, the transmission assembly further includes a ring gear receiving and operably engageable with the planetary gear, and a lock block moveable to operably engage with the ring gear to prevent the ring gear from rotating.

In some embodiments, the ring gear defines multiple radially arranged notches, and the lock block includes a detent configured to be receivable in at least one of the notches when the lock block is moved in an engagement position upon depression of a trigger. In some embodiments, the trigger includes an extension that is received in a slot defined in the lock block.

In some approaches, a gearbox is configured to receive the planetary gear, the sun gear, the ring gear and the lock block. The gearbox defines a channel configured to slidable receive the lock block.

In some embodiments of the approach, a gearbox cover is connectable to the gearbox for enclosing at least the planetary gear, the sun gear and the ring gear between the gearbox cover and the gearbox. A portion of the sun gear extends out past the gearbox cover and is operably engageable with a bevel gear exterior of the gearbox and the gearbox cover. The bevel gear is operably engageable with a rack of the piston rod and is configured for converting rotational output of the sun gear to the translational output of the piston rod.

In some embodiments, a portion of the sun gear and a first portion of the bevel gear are enclosed within a transmission housing that is connectable to the gearbox cover. A second portion of the bevel gear is exterior of the transmission housing and is operable engageable with the rack of the piston rod.

In some embodiments, the sun gear is operably engageable with a bevel gear configured to be operably engageable with a rack of the piston rod and for converting rotational output of the sun gear to the translational output of the piston rod.

In some embodiments, the planetary gear and the sun gear is a plurality of successive planetary gear and sun gear stages. An initial planetary gear is operable engageable with the output of the motor, and a final planetary gear is operable engageable with the ring gear. Alternatively in some embodiments, the final planetary gear is operable engageable with a spindle including a bevel pinion gear that is operably engageable with a bevel gear. The bevel gear is operably engageable with a rack of the piston rod and is configured for converting rotational output of the spindle to the translational output of the piston rod.

In another approach, a tube is configured to receive the chub pack and a piston associated with the piston rod. The tube is positioned in the housing with one end of the tube adjacent the nozzle tip.

In some embodiments, the piston rod includes a longitudinal flat surface slidably engageable with an interior wall of the housing. The longitudinal flat surface or the interior wall is configured to prevent the piston rod from rotating.

In some embodiments, the piercing projection further includes a piercing end, and an interior side defining at least one channel in the interior side and along a longitudinal axis of the piercing projection. The channel being in fluid communication with a hollow interior of a dispensing end of the nozzle tip. The piercing projection can further include an exterior side angled from a longitudinal axis of the nozzle tip, and the interior side is parallel with the longitudinal axis of the nozzle tip.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is important, therefore, that the claims be regarded as including such equivalent constructions insofar as they do not depart from the spirit and scope of the present technology.

It is another object of the present technology to provide a new and improved material dispensing system that may be easily and efficiently manufactured and marketed.

An even further object of the present technology is to provide a new and improved material dispensing system that has a low cost of manufacture with regard to both materials and labor, and which accordingly is then susceptible of low prices of sale to the consuming public, thereby making such material dispensing system economically available to the buying public.

Still another object of the present technology is to provide a material dispensing system for controllably dispensing material from a packaging, such as but not limited to a chub pack or a prefilled tube. This allows for the controlled dispensing of material from the packaging using an interchangeable nozzle tip featuring piercing projections that pierce the packaging thereby allowing the material to be dispensed from the nozzle tip.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology.

Referring now to the drawings, and particularly to FIGS. 1-14, an embodiment of the material dispensing system of the present technology is shown and generally designated by the reference numerals 10, 100.

In FIG. 1, a new and improved material dispensing system 10 of the present technology for controllably dispensing material from a packaging such as a chub pack is illustrated and will be described. More particularly, the material dispensing system 10 can have a dispensing unit 12, a cover 40 pivotably connected to the dispensing unit 12 via a hinge 42, and a packaging compression assembly capable of compressing the packaging toward a nozzle tip 70.

For exemplary purposes, the dispensing unit 12 can have a configuration similar to a gun featuring a main housing 14, a hand grip 18, a trigger 20, a piston grip 22, and a piston rod 24. It can be appreciated that the main housing 14 can be in the form without the hand grip 18, the trigger 20, the piston grip 22 or the piston rod 24. The main housing 14, the hand grip 18 and the trigger 20 can be made of, but not limited to, plastic, metal, composite, an alloy or any combination thereof. The dispensing unit 12 can be a single molded unit or can be made of separable and attachable sections secured together by, but not limited to, adhesive, welding, fasteners, tabs, locks, clips or other securing means.

The main housing 14 or the hand grip 18 can include a recess defined therein which features a configuration capable of receiving a side of the piston grip 22 so as to produce a smooth and flush transition therebetween when the piston grip 22 is received in the recess.

Figure 2:
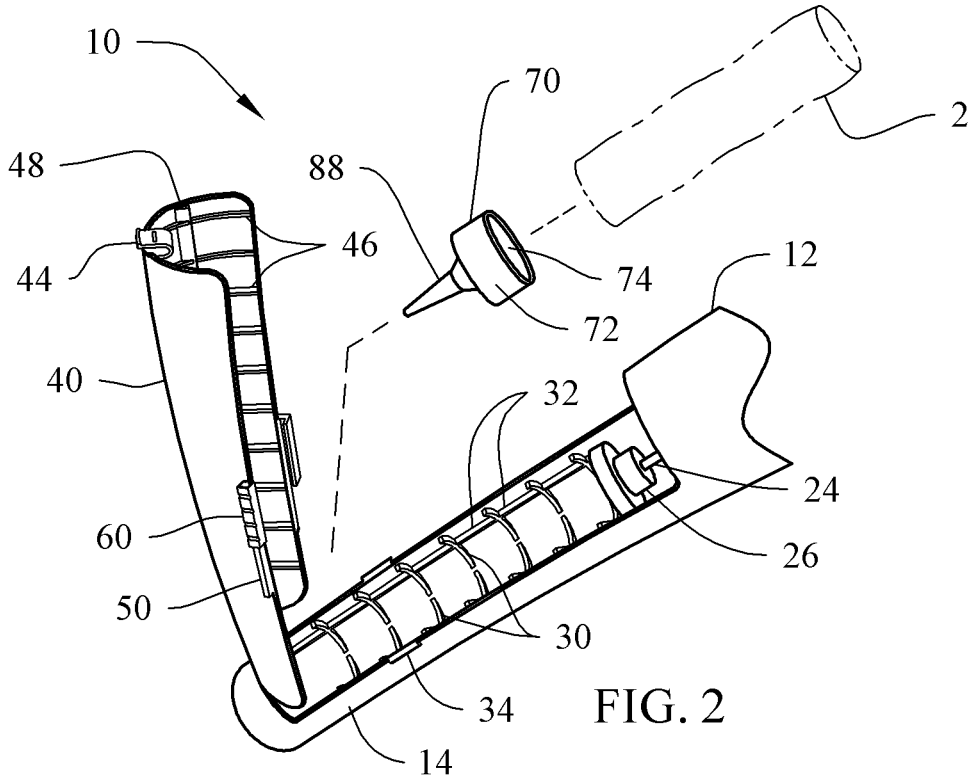
FIG. 2 is a top-right perspective view of the material dispensing system with the cover in the open position, and the nozzle tip and chub pack exploded.
Figure 3:
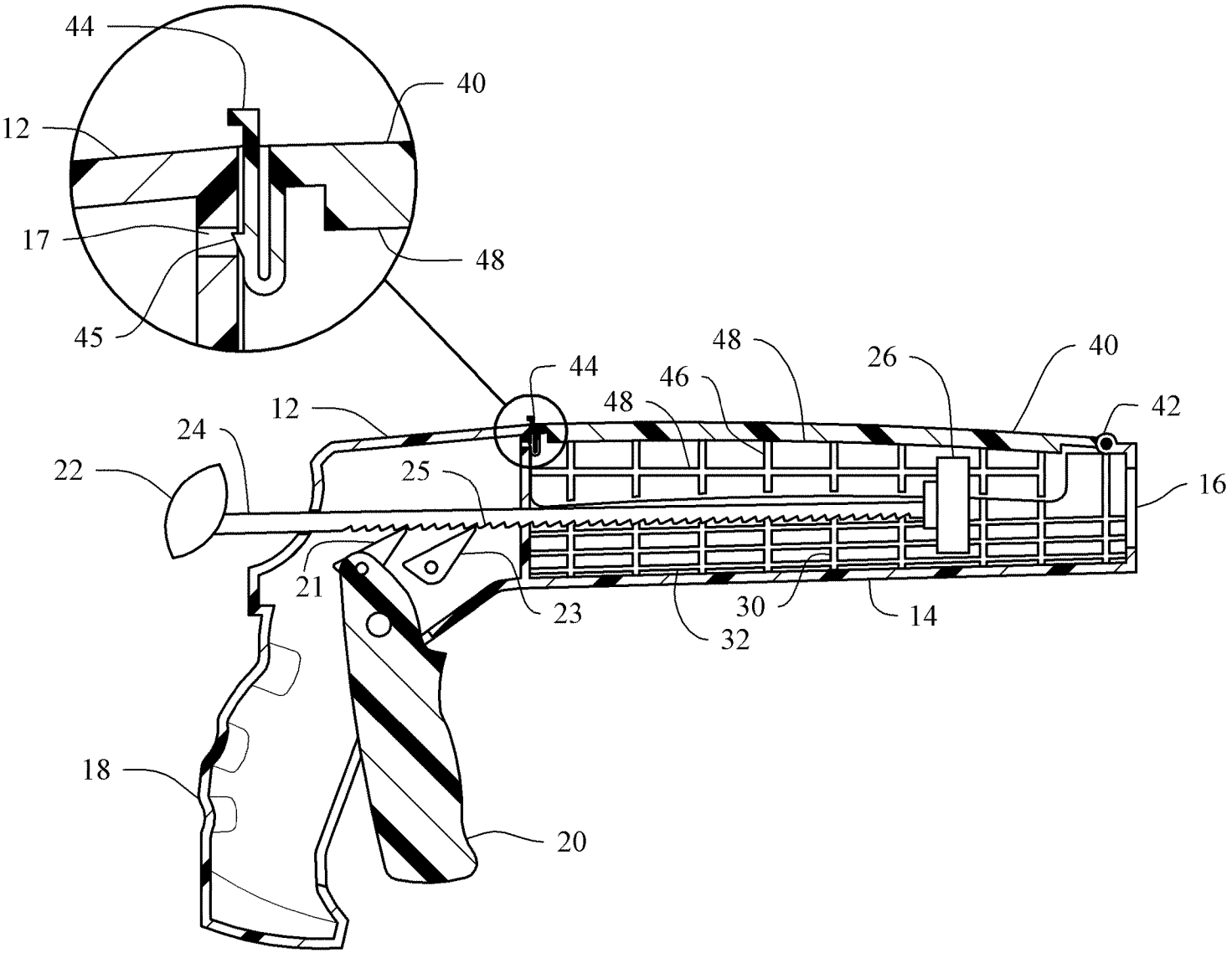
FIG. 3 is a cross-sectional view of the material dispensing system, with an enlarged section of the cover release member.

With reference to FIGS. 2 and 3, the main housing 14 can include a nozzle tip receiving end featuring an opening 16 having a configuration capable of receiving a dispensing end 88 of the nozzle tip 70 therethrough. The main housing 14 further defines an interior space having a configuration capable of receiving a packaging such as a chub pack 2 therein. The nozzle tip 70 can have a configuration capable of receiving an end portion of the chub pack 2. It can be appreciated that the nozzle tip 70 can be integrally formed with an end of the main housing 14, thereby creating a single main housing and nozzle tip unit.

The main housing 14 further includes an internal skeletal framework including one or more lateral housing ribs 30, and one or more longitudinal housing spars 32. The housing ribs 30 are in spaced apart relationship with each other, and extend into the interior space of the main housing 14. The housing ribs 30 can have an arcuate interior edge of a constant or varying curvature.

The piston rod 24 is connected to a piston 26 that is slidably receivable in the interior space of the main housing 14. The trigger 20, when operated by a user, can advance the piston rod 24, which thus advances the piston 26 along a longitudinal axis of the main housing 14 and interior of the housing ribs 30 and housing spars 32.

As best illustrated in FIG. 3, it can be appreciated that the trigger 20 is pivotable with the dispensing unit 12 so as to operate a piston rod advancing assembly. The piston rod advancing assembly can include a ratchet pawl 21 pivotably associated with an end portion of the trigger 20. The ratchet pawl 21 can be biased so as to pivot a ratchet end into and out of engagement with ratchet teeth 25 formed in a side of the piston rod 24. A locking pawl 23 can be included which is biased so as to pivot a locking end of the locking pawl 23 into and out of engagement with the ratchet teeth 25. The piston rod 24 can be rotated so as to engage or disengage the ratchet teeth 25 with the ratchet pawl 21 and/or the locking pawl 23. The trigger 20 can be biased so that an end opposite the ratchet pawl 21 is forced away from the hand grip.

It can be appreciated that a gear system, a motor system, an air bladder system or a tongue and roller system can be used in lieu of the above described ratcheting assembly.

In use, it can be appreciated that a user can squeeze the trigger 20, which pushes the ratchet end of the ratchet pawl 21 into engagement with one of the ratchet teeth 25. Further squeezing of the trigger 20 would advance the piston rod 24 toward the opening 16. Advancement of the piston rod 24 provides a ratcheting action between the ratchet teeth 25 and the locking pawl 23, which has a configuration capable of allowing the piston rod 24 to advance toward the opening 16 while preventing retraction of the piston rod 24 unless the ratchet teeth 25 are rotated out of engagement with the ratchet pawl 21 and locking pawl 23. Release of the trigger 20 will move the ratchet pawl 21 in an opposite direct of advancement for further advancing of the piston rod 24.

The cover 40 further includes an internal skeletal framework including one or more lateral cover ribs 46, and one or more longitudinal cover spars 48. The cover ribs 46 are in spaced apart relationship with each other, and extend into an interior space of defined by the cover 40. The cover ribs 46 can have an arcuate interior edge of a constant or varying curvature.

The cover 40 can further include a lifting or release member 44 having a configuration capable of being engaged by a user to disengage a tab 45 from a tab opening 17 defined in a back wall of the main housing 14. The release member 44 can be a biasing U-shaped member extending from an end of the cover 40, with the biasing force pushing the tab 45 into engagement with the tab opening 17 when the cover 40 is in the closed position, as best illustrated in the enlarged section of FIG. 3. The tab 45 can include an angled surface to assist in closing of the cover 40, and a ledge for engaging with the tab opening 17. The ledge has a configuration capable of securing the cover 40 in the closed position.

The release member 44 is capable of being moved so that the tab 45 is disengaged from the tab opening 17, thereby allowing the cover 40 to be opened gaining access to the interior space of the main housing 14. Lifting the cover 40 by way of the release member 44 pivots the cover 40 away from the main housing 14 via the hinge 42 that is associated with an end of the cover 40 opposite the release member 44.

A locking slide 60 is slidable associated with a cover rail 50 on one or both sides of the cover 40. The locking slide 60 has a configuration capable of slidably receiving a housing rail 34 extending from the main housing 14 in a locked position. In the locked position, the locking slide 60 receives a portion of both the cover rail 50 and the housing rail 34 so as to prevent the cover 40 from pivoting away from the main housing 14. The locking slide 60 can slide away from the housing rail 34 in an un-locked position so that the cover 40 can freely pivot away from the main housing 14.

It can be appreciated that a user could insert an end of the chub pack 2 into the opening 74 of the nozzle tip 70, then insert both the nozzle tip 70 and chub pack 2 into the interior space of the main housing 14 so that the dispensing end 88 of the nozzle tip 70 extend from the opening 16 of the main housing 14.

Figure 4:
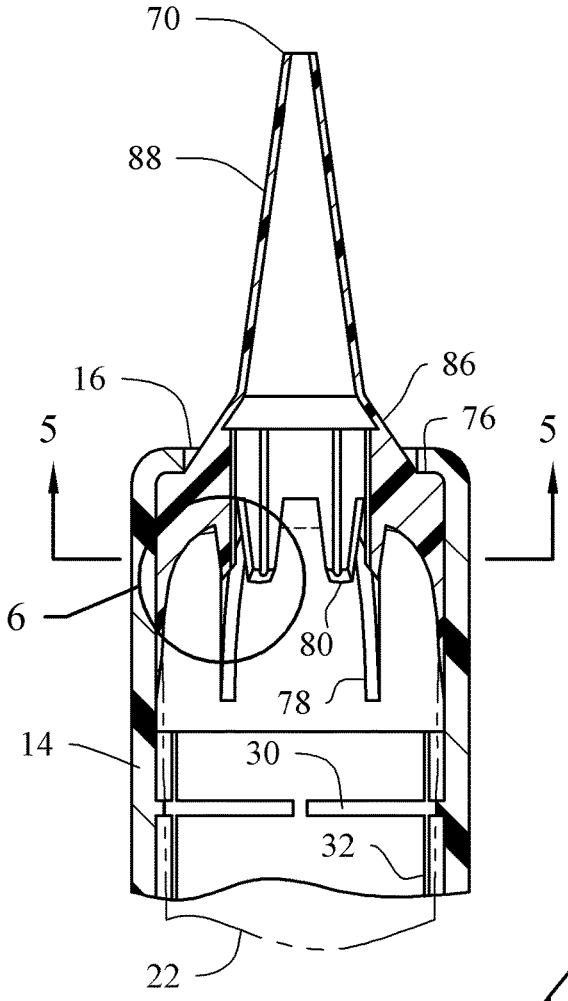
FIG. 4 is a cross-sectional view of the nozzle tip assembled in the dispensing unit taken along line 4-4 in FIG. 1.
Figure 5:
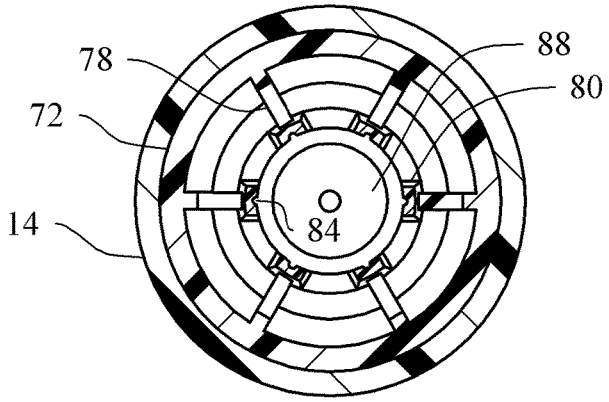
FIG. 5 is a cross-sectional view of the nozzle tip taken along line 5-5 in FIG. 4.
Figure 6:
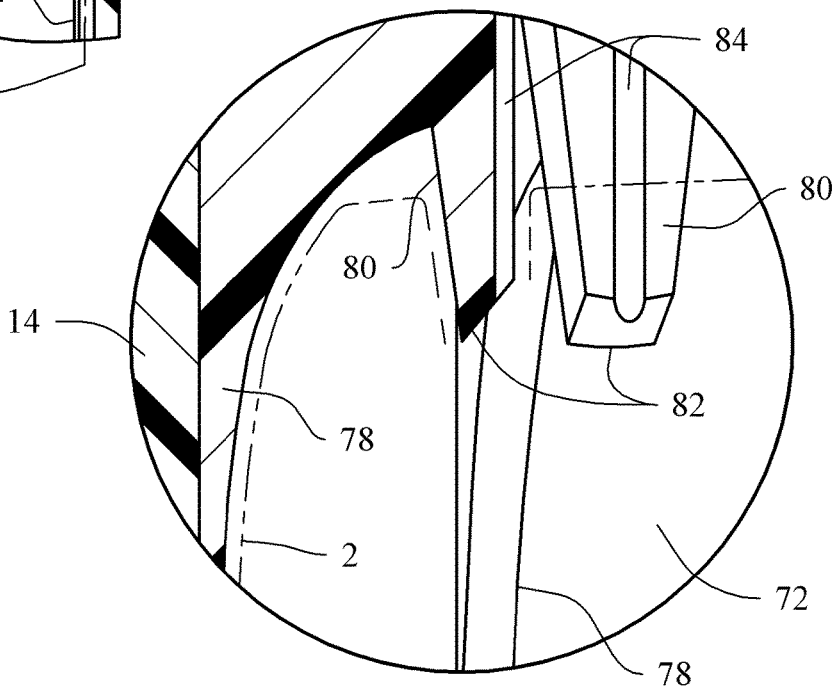
FIG. 6 is an enlarged cross-sectional view of the nozzle tip piercing the chub pack taken from section 6 in FIG. 4.

With reference to FIGS. 4-6, the dispensing end 88 of the nozzle tip 70 is received through the opening 16 of the main housing 14. The nozzle tip 70 includes a receiving end 72 defining an opening 74, and a ledge 76. The opening 74 has a configuration capable of receiving an end of the chub pack 2. The ledge 76 is located opposite the opening 74, and has a configuration capable of abutting against an edge of the main housing 14 that defines the opening 16. The ledge 76 prevents the nozzle tip 70 from being pushed through and out the opening 16.

A conical transition section 86 can extend away from the ledge 76 in a converging direction, and the dispensing end 88 can extend from the transition section 86 in a conically converging direction. The receiving end 72, transition section 86 and the dispensing end 88 all have a hollow interior. It can be appreciated that the dispensing end 88 can feature a closed distal end, which allows a user to cut off a section of the dispensing end 88 to form an opened dispensing end. The open dispensing end can be of any size determined by the location of the cut along the conically shaped dispensing end 88.

The receiving end 72 can include one or more radially arranged internal ribs 78, and one or more radially arranged piercing projections 80, as best illustrated in FIGS. 4 and 5. The internal ribs 78 extend into the interior of the receiving end 72 and have a generally arcuate or elliptical configuration capable of receiving and supporting an end portion of the chub pack 2. The internal ribs 78 can further provide structural support for the receiving end 72, and can further assist in guiding the end of the chub pack 2 toward the piercing projections 80.

It can be appreciated that the piercing projections 80 can be integrally formed with the main housing 14 or with a nozzle tip 70 that is integrally formed with the main housing 14.

As best illustrated in FIG. 6, the piercing projections 80 can extend into the interior of the receiving end 72 in a direction from a terminus of the internal ribs 78 toward the opening 74. The piercing projections 80 can include a piercing end 82, an exterior side angled from a longitudinal axis of the nozzle tip 70, and an interior side parallel with the longitudinal axis of the nozzle tip 70. The piercing end 82 can be angled to create an edge having a configuration capable of piercing the chub pack 2 when sufficient pressure is applied between them.

The piercing projections 80 can further include at least one channel 84 defined along a longitudinal axis of the interior side of the piercing projections 80. The channel 84 of each piercing projections 80 is in communication with the hollow interior of the nozzle tip 70. Once the chub pack 2 is punctured by the piercing projections 80, the piercing projections 80 are inserted/received into the interior of the chub pack 2 so that any material in the chub pack 2 is allowed to flow through the channel 84 and into hollow interior of the nozzle tip 70, and then into the dispensing end 88.

It can be appreciated that after the chub pack 2 is inserted into the receiving end 72, the nozzle tip 70 and/or the chub pack 2 can be rotated so that the piercing projections 80 puncture the chub pack 2 and consequently remove a section of the chub pack 2 punctured by the piercing projections 80. It can further be appreciated that the nozzle tip 70 can be of different shapes and sizes, and that it can be provided as a kit including multiple nozzle tips with dispensing ends of different sizes, shapes, lengths and/or configurations.

Figure 7:
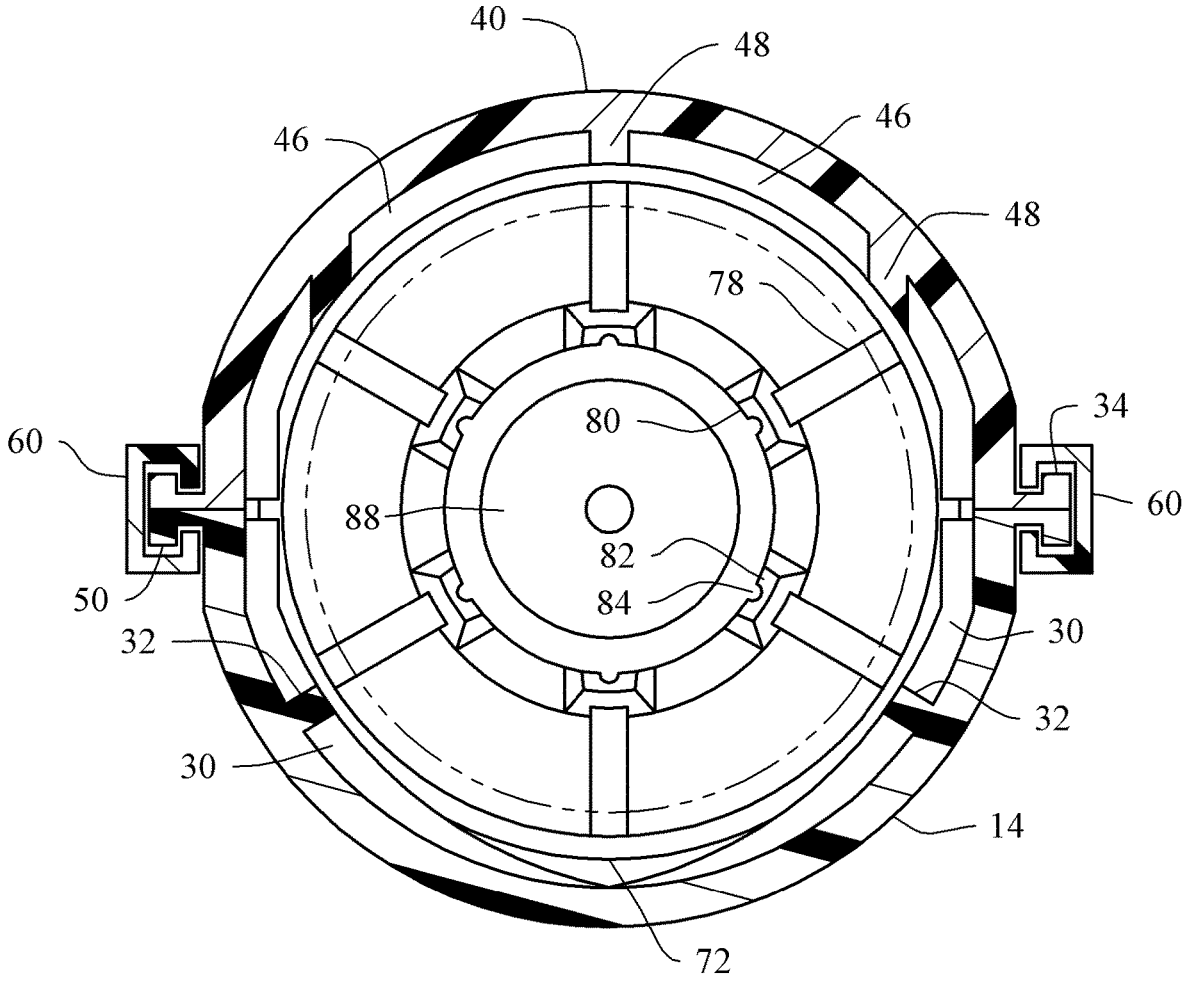
FIG. 7 is a cross-sectional view of the gun housing, the cover and the locking tab taken along line 7-7 in FIG. 1.
Figure 8:
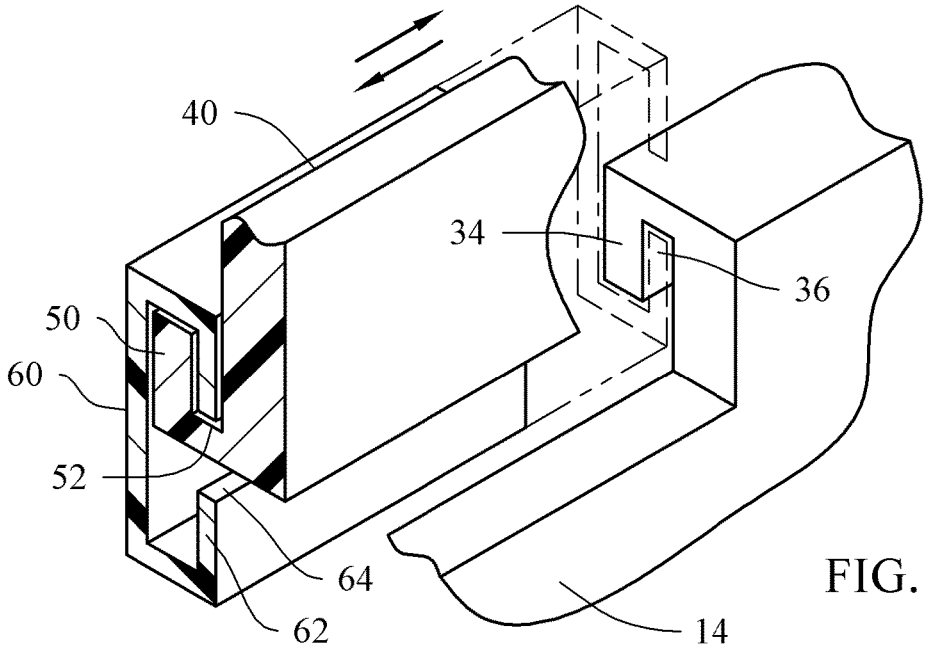
FIG. 8 is a cross-sectional perspective view of the locking tab.

With reference to FIGS. 6 and 7, the housing rail 34 can be a flanged edge offset from a side of the main housing 14 to define a housing notch 36 therebetween. The cover rail 50 can be a flanged edge offset from a side of the cover 40 to define a cover notch 52 therebetween, with the flanged edge of the cover rail 50 extending in a direction opposite the housing flanged edge when the cover 40 is in the closed position. The locking slide 60 generally has a C-channel configuration with flanged sides 62 extending toward each other to define a slot 64 therebetween. The C-channel configuration of the locking slide 60 is capable of receiving the housing flanged edge and the cover flanged edge so that the locking slide 60 can slide along both the housing rail 34 and the cover rail 50 when the cover 40 is in the closed position. The housing notch 36 and the cover notch 52 have a configuration capable of slidably receiving the flanged sides 62 of the locking slide 60, respectively.

The cover rail 50 can further include stop edges located at both ends of the cover rail 50, with the stop edges having a configuration capable of preventing the locking slide 60 from being removed from the cover rail 50.

The locking slide 60, the housing rail 34 and the cover rail 50 each have a length. The length of the housing rail 34 is less than the length of the cover rail 50 by at least a distance of the length of the locking slide 60. This is to allow the locking slide 60 to slide out past the housing rail 34 so that the cover 40 can be opened.

Alternatively, it can be appreciated that the length of the housing rail 34 and the length of the cover rail 50 can be switched so that the locking slide 60 is positioned on the housing rail 34, with the stop edges associated with the housing rail 34.

It can be appreciated that the material dispensing system 10 of the present technology can include draw back system (not shown) to ensure bead flow or flow of the material from the chub pack 2 ceases when the trigger 20 is disengaged. The draw back system can have a configuration capable of drawing back of pressure to avoid unwanted flow of material out the nozzle tip 70. The draw back system can include, but not limited to: a biasing assembly which is capable of pushing back against a part of the packaging compression assembly or against the chub pack 2; a retraction assembly which is capable of retracting at least a portion of the packaging compression assembly or the chub pack 2; or a nozzle tip moving assembly which is capable of moving the nozzle tip 70 away from the chub pack 2.

Currently, most ratchet systems will maintain a level of pressure on the chub pack 2 despite while the user is not using the trigger causing spillage. The draw back system could prevent this unwanted pressure against the chub pack thereby preventing spillage of material.

It can now be understood that the material dispensing system 10 of the present technology can be used to dispense a material, such as but not limited, caulk, adhesive, sealant, paste, cement and the like, from a chub pack 2. In exemplary use, a user can install a first end of the chub pack 2 into the opening 74 of the nozzle tip 70. With the piston 26 fully retracted and the cover 40 lifted in an open position, the assembled nozzle tip 70 and chub pack 2 can then be inserted into the interior space of the main housing 14 so that the dispensing end 88 of the nozzle tip 70 is received through the opening 16 of the main housing 14.

It can be appreciated that the nozzle tip 70 can be inserted into the interior space of the main housing 14 first, and after which the chub pack 2 can be inserted into the interior space of the main housing 14 so that the first end of the chub pack 2 is received through the opening 74 of the nozzle tip 70.

With the nozzle tip 70 and chub pack 2 installed in the interior space of the main housing 14, the user can then close the cover 40 so that the cover rail 50 is adjacent the housing rail 34. When the cover 40 is in the closed position, the locking slide 60 can then be slid along the housing rail 34 and the cover rail 50 so that the cover 40 is locked in the closed position and prevented from being pivoted away from the main housing 14.

The user can then operate the trigger 20 to advance the piston rod 24, which advances the piston 26 toward a second end of the chub pack 2. The advancement of the piston 26 pushes the first end of the chub pack 2 against the piercing projections 80 so that the piercing end 82 punctures through the first end of the chub pack 2, thereby opening a passage between the interior of the chub pack 2 and the hollowing interior of the nozzle tip 70.

Continued advancement of the piston 26 against the second end of the chub pack 2 could expand the sidewalls of the chub pack 2, which would consequently be contained by the housing ribs 30, the housing spars 32, the cover ribs 46 and the cover spars 48. This continued advancement of the piston 26 can force the material out of the chub pack 2 and through the channel 84 of the piercing projections 80. The material can then be forced through the hollow interior of the nozzle tip 70 and dispensed out an opening defined or cut in the dispensing end 88.

It can be appreciated that when the locking slide 60 is slid over both the housing rail 34 and the cover rail 50, the locking slide 60 can secure the cover 40 in the closed position and resist the forces acting on the cover 40 by an expanding chub pack 2.

The chub pack 2 can be removed and replaced by griping the piston grip 22 and retracting the piston 26 away from the chub pack 2. The user can then slide the locking slide 60 away from and past the housing rail 34, thereby unlocking the cover 40. The cover 40 can then be pivoted and/or lifted away from the main housing 14 with assistance from the release member 44. After which, the chub pack 2 can be removed, with or without the nozzle tip 70.

Figure 9:
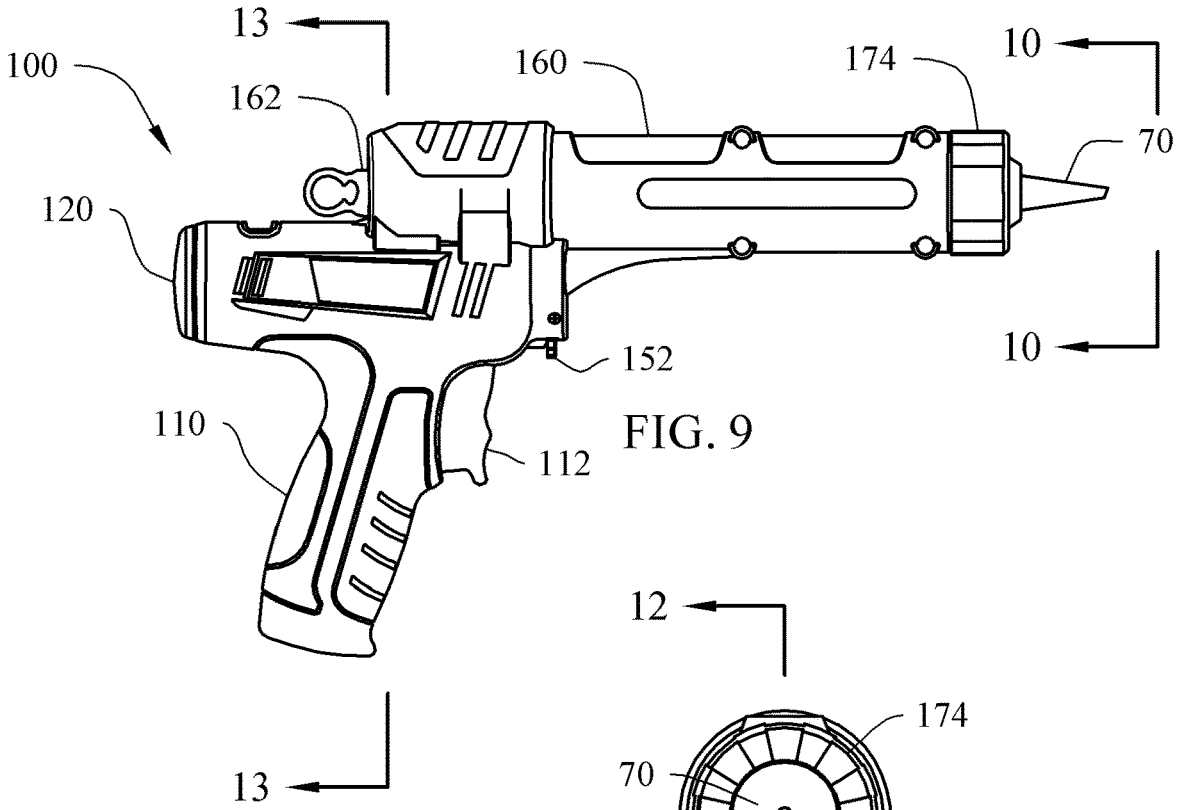
FIG. 9 is a side plane view of the motorized sealant dispensing system of the present technology.
Figure 10:
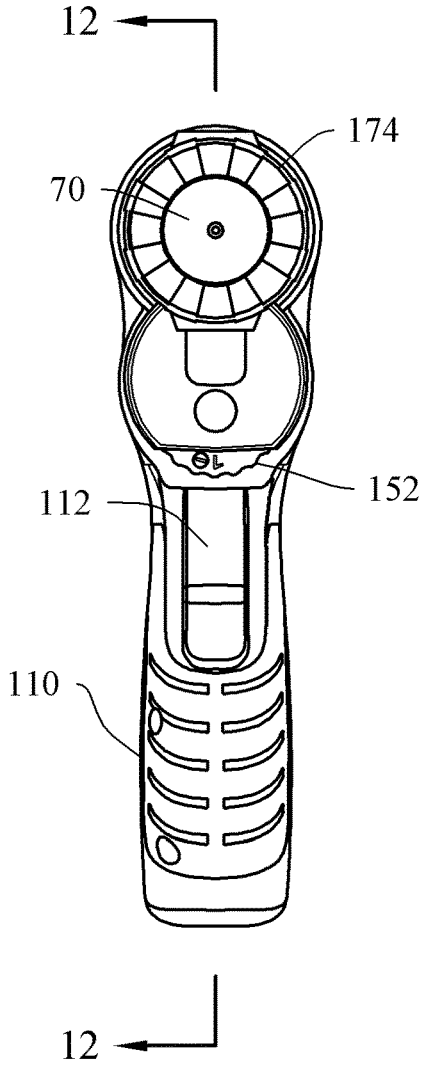
FIG. 10 is a front plane view of the motorized sealant dispensing system of the present technology taken along line 10-10 in FIG. 9.

Referring to FIGS. 9 and 10, the present technology can be associated with a motorized material dispensing system 100 including a handle section 110, a drive section 120, and a material chamber section 160 for receiving the material packaging or chub pack 2 and the nozzle tip 70. A cap 174 can be utilized to secure the nozzle tip 70 to an opened end of the material chamber section 160. A piston rod 162 is moveable associated in the material chamber section 160, and is configured to push against the chub pack 2 when operated. It can be appreciated that the motorized dispensing system 100 can include an overall housing made of pieces or sections that are connected together to form the housing.

Figure 11:
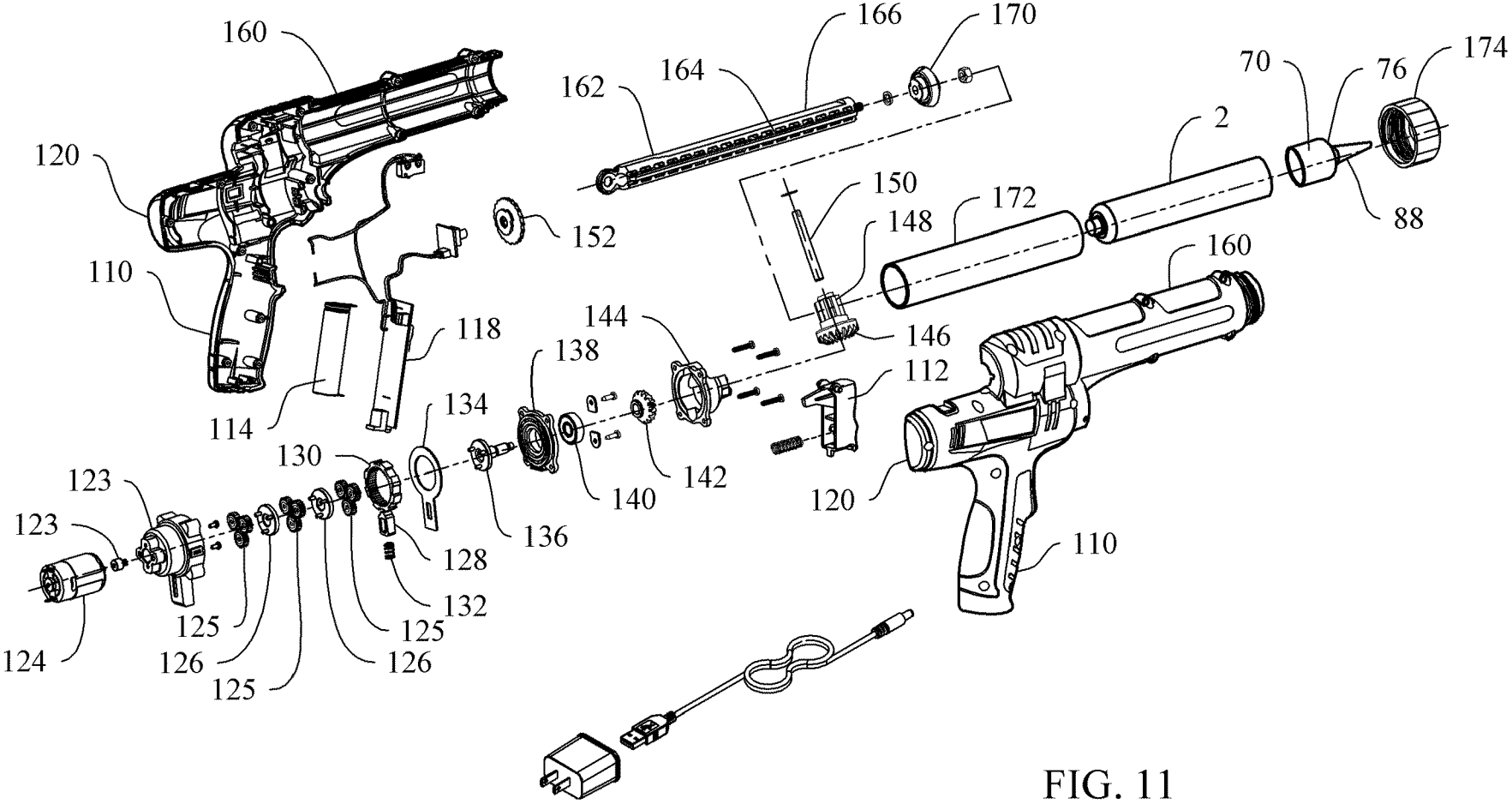
FIG. 11 is an exploded view of the motorized sealant dispensing system of the present technology.
Figure 12:
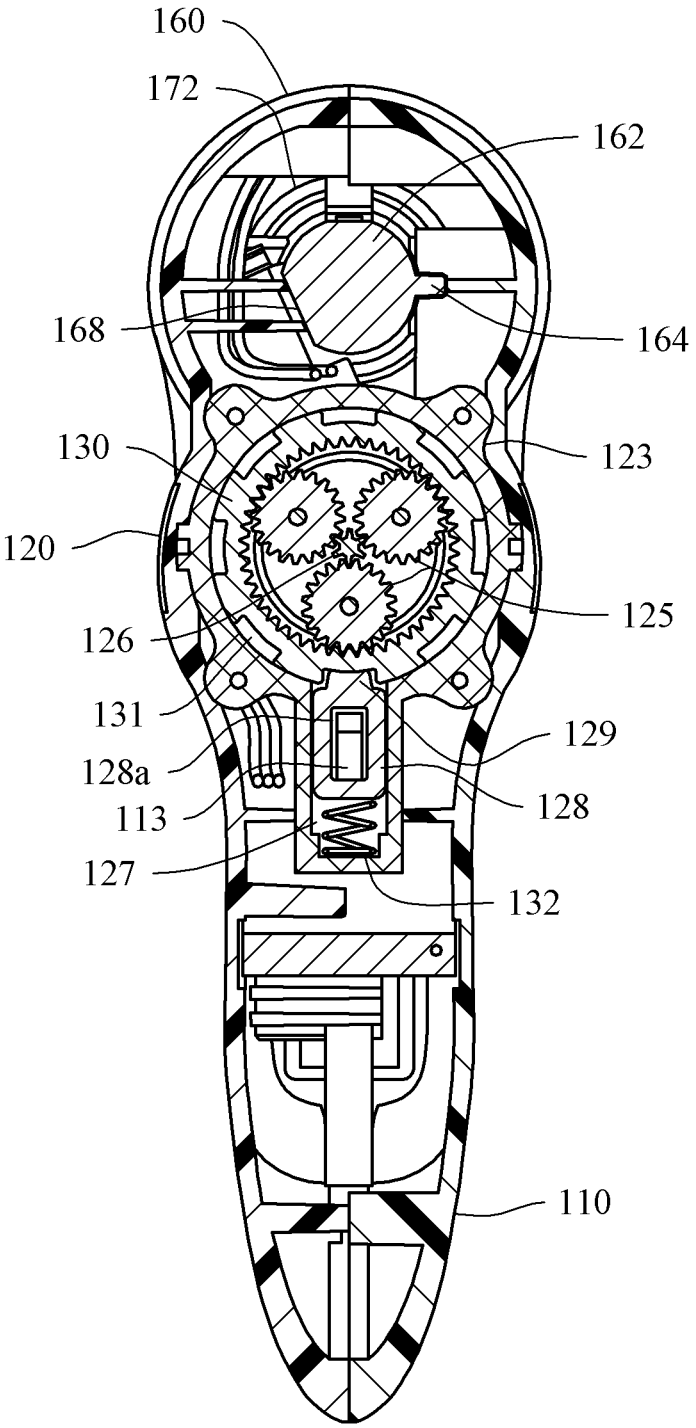
FIG. 12 is cross-sectional view of the handle section, the gear box section and the piston rod taken along line 12-12 in FIG. 9
Figure 13:
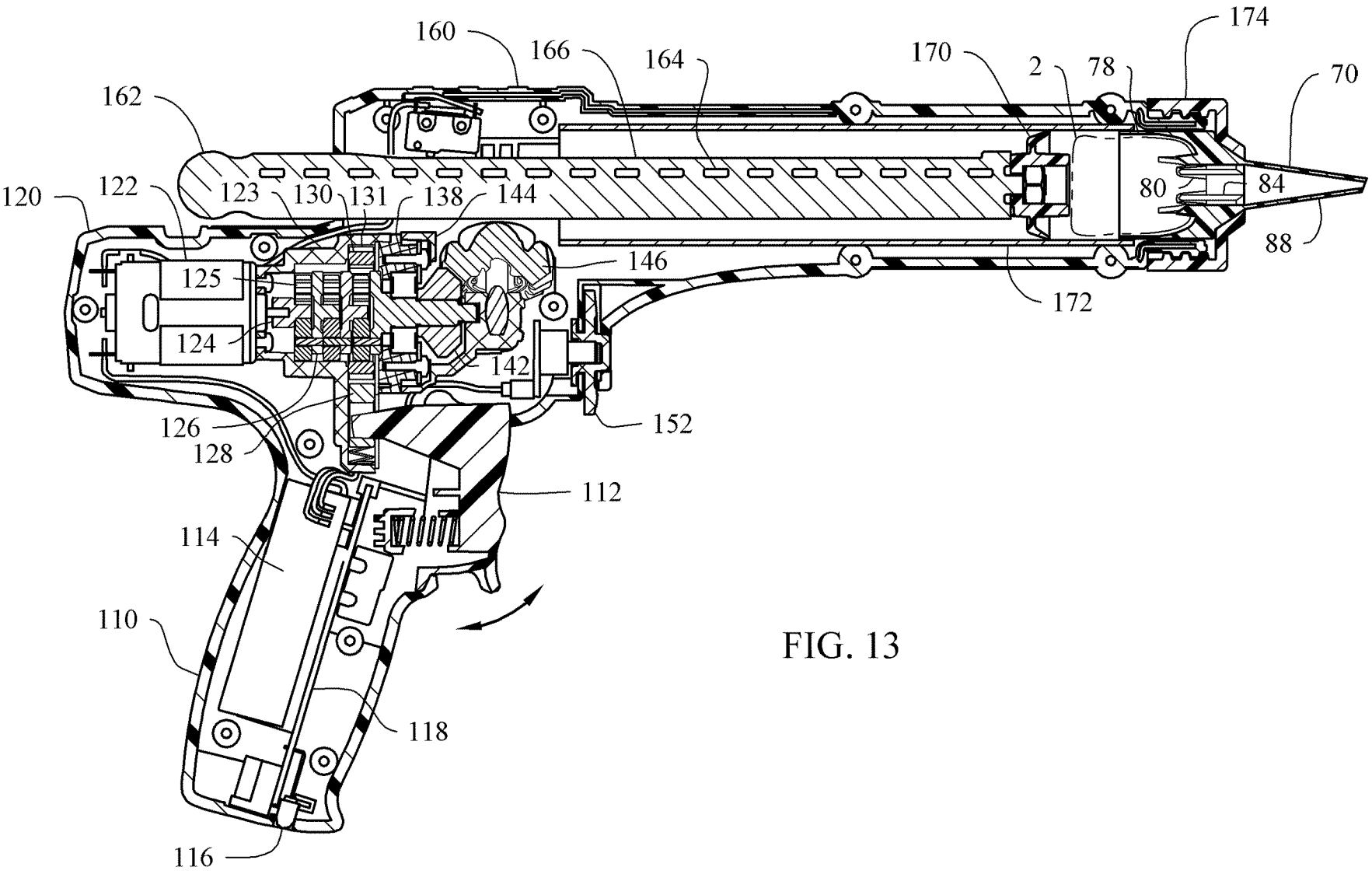
FIG. 13 is cross-sectional view of the motorized sealant dispensing system taken along line 13-13 in FIG. 10.

With references to FIGS. 11-13, the handle section 110 includes a trigger 112 pivotably mounted and spring biased, a power source (e.g. a battery) 114, and a charging port 116 in communication with the battery 114. A controller, processor, switch or a printed circuit board (PCB) 118 including circuitry, processor, memory and/or controllers can be provided to control power to and from the battery 114, and operations of the motorized material dispensing system 100. The trigger 112 features a finger engaging surface exterior of the handle section 110, and a trigger extension 113 interior of the handle section 110. The handle section 110 can include an ergonomic shape with padding, gripping means, cushioning or other means to provide comfort or ease of use for a user grasping the handle section 110.

The drive section 120 is adjacent the handle section 110, and includes a motor and gearbox assembly operably positioned therein. The motor and gearbox assembly includes an electric motor 122, at least one planetary gear 125 and sun gear 126 stage or assembly, at least one lock block 128, and a transmission 144 for converting a rotational output of the planetary assembly to a translational output of the piston rod 162.

The motor 122 can be configured as a DC motor that receives power from the battery 114. In an alternative, the motor 122 may be powered by a remote power source (e.g., a household electrical outlet) directly through a power cord or indirectly by way of the battery 114 that receives power from the remote power source. The motor 122 is controllably activated by depressing the trigger 112, which can be in operable communication with the PCB 118 for providing variable power to the motor 122.

Figure 14:
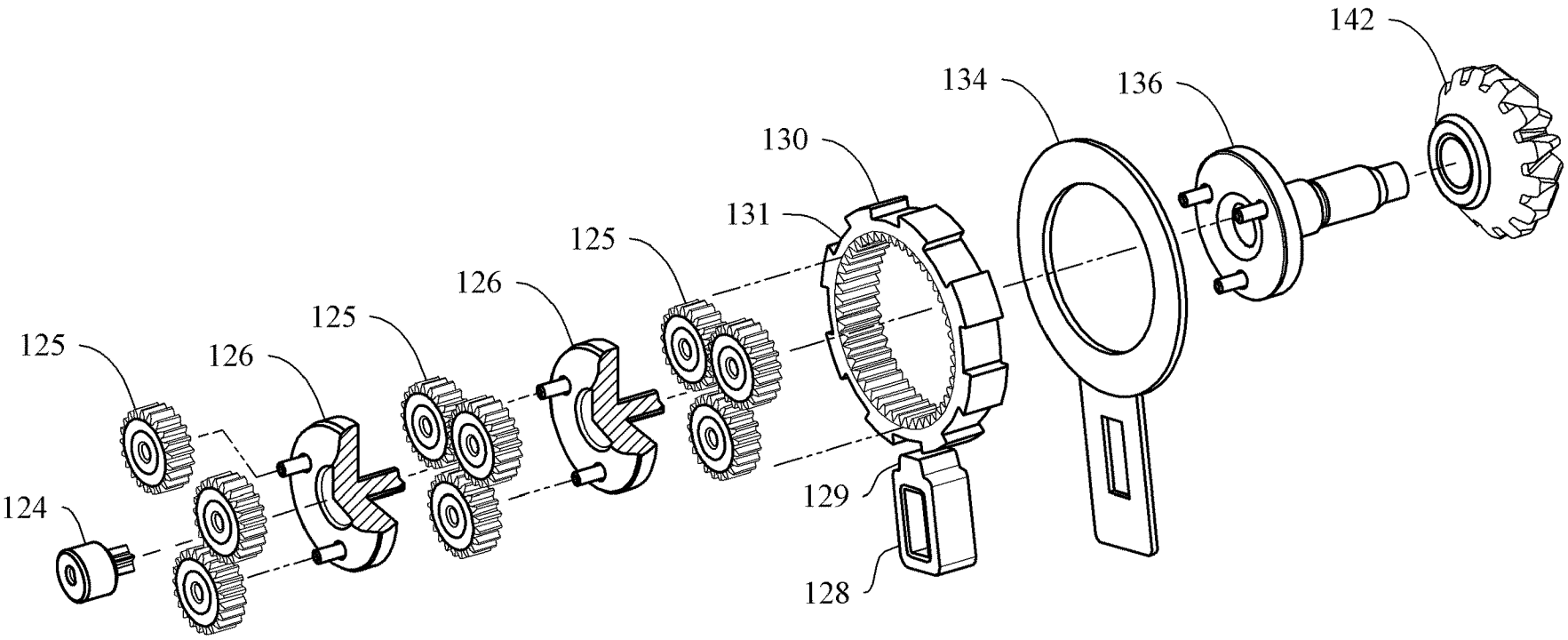
FIG. 14 is an enlarged exploded view of the gearbox assembly.

Attached to the motor 122 is a gearbox 123 configured to house the planetary gear 125 and sun gear 126 assembly. A motor pinion gear 124 is operably engageable with an output of the motor 122, and extends into the gearbox 123 for rotation therein. It can be appreciated that the planetary gear assembly 125 consists of multiple planet gears that are orbitally rotating and engageable with the motor pinion gear 124 or the sun gear 126. The motor pinion gear 124 engages with the planetary gears 125, which in turn, engages with the sun gear 126, as best illustrated in FIG. 14. The planetary gear 125 and sun gear 126 assembly are configured to reduce the rotational speed of the motor pinion gear 124, and thus the motor 122. It can be appreciated that multiple successive planetary and sun gear assemblies or stages can be utilized to reduce the motor speed accordingly.

Surrounding the planetary gear assembly 125 or the last planetary gear stage is a ring gear 130 including internally extending gear teeth engageable with the planetary gears 125 orbitally rotating therein. The ring gear 130 includes a plurality of radially arranged notches 131 defined in an exterior surface thereof, as best illustrated in FIGS. 12-14.

The lock block 128 is slidable received in a groove or channel 127 defined in the gearbox 123. The extension 113 of the trigger 112 is receivable in an opening or slot 128*a* defined in the lock block 128 to impart a translation movement from the trigger 112 to the lock block 128. The lock block 128 includes a detent 129 that is configured to be receivable in at least one of the notches 131 of the ring gear 130 when the trigger 112 is depressed, thereby performing an operation of a clutch. A spring 132 provides a biasing force against the lock block 128 toward the ring gear 130. The detect 129 and the notches 131 of the ring gear 130 are configured so that the ring gear 130 rotates freely when the trigger 112 is not depressed or is released, thereby immediately halting advancement of the piston rod 162 even if the motor 122 is still operating. Depressing the trigger 112 results in movement of its extension, which in turn moves the lock block 128 toward the ring gear 130 until the detent 129 is received in one of the notches 131. When the detent 129 is received in one of the notches 131, the ring gear 130 is prevented from rotating and thus allowing the transfer of torque to the transmission 144.

A washer or back plate 134 is adjacent the ring gear 130 and lock block 128, and is configured to secure the lock block 128, the ring gear 130, and the planetary gears 125 and sun gear 126 assembly in the gearbox 123. The back plate 134 includes a slot configured to slidably receive the extension of the trigger 112.

A spindle 136 rotatably supports the final planetary gear stage 125 that is engaged with the ring gear 130. The spindle 136 extends through the back plate 134 and a gearbox cover 138 via a spindle bearing 140. The gearbox cover 138 is secured to an open end of the gearbox 123 thereby sealing and enclosing the lock block 128, the ring gear 130, and the planetary gears 125 and sun gear 126 stages. The spindle 136 is capable of rotating when the ring gear 130 is locked and prevented from rotating, upon which torque from the planetary gears 125 is transferred to the spindle 136 and thus to the transmission 144.

The transmission 144 is secured to the gearbox cover 138 and in turn to the gearbox 123. A bevel pinion gear 142 is secured to a free end of the spindle 136 that is exterior of the gearbox 123 and interior of the transmission 144. A bevel gear 146 is rotatably received, via a shaft 150, in the transmission 144, and is operably engageable with the bevel pinion gear 142. The bevel gear 146 has a translation gear section 148 that is exterior of the transmission 144. The bevel gear 146 and its translation gear section 148 are configured for converting the rotational output of the spindle 136 to a translational output of the piston rod 162.

A dial 152 may be rotatably supported by the drive section 120 adjacent the handle section 110 and forward of the trigger 112. A small portion of the dial 152 extends outwardly and through an opening in the drive section 120 to be accessible by a user. The dial 152 is operably connected with the PCB 118 for controlling at least in part the torque or speed of the motor 122, as best illustrated in FIG. 13.

The material chamber section 160 is adjacent and above the drive section 120, and includes a first end defining an opening configured to slidably receive therethrough the piston rod 162, and an opened second end featuring an exteriorly threaded or engaging means portion. The piston rod 162 includes a first end capably of being grasped by a user, a longitudinally running gearing or rack 164, a longitudinally flat first section 166, a longitudinally flat second section 168, and a second end featuring a threaded stud. A piston 170 is securable to the second end by way of a fastener engaged with the threaded stud. The piston 170 has a diameter greater than the piston rod 162, and is configured to contact and press against the chub pack 2.

The rack 164 extends from the piston rod 162 along a majority or an entirety of its longitudinal length, and is configured to engage with the translation gear section 148 of the bevel gear 146. Rotation of the bevel gear 146 results in rotation of the translation gear section 148, which in turn results in longitudinal movement of the piston rod 162.

The material chamber section 160 may include a position sensing device that is in contact with the first section 166, and is in communication with the PCB 118. This position sensing device is configured and capable of determining the longitudinal position and/or travel distance of the piston rod 162. The material chamber section 160 may further include an internally projecting wall that extends toward and contacts the second section 168. This internally projecting wall is configured to keep the piston rod 162 in a predetermined orientation so that the rack 164 is engageable with the translation gear section 148 of the bevel gear 146.

A tube 172 is positioned in the material chamber section 160, and defines a tubular interior chamber configured to slidably receive the piston 170. The tube 172 may have a diameter less than the opened second end of the material chamber section 160, thereby allowing for different tubes 172 to be utilized or for the utilization of a prefilled material tube. The tube 172 further defines an interior space having a configuration capable of receiving the chub pack 2 or the prefilled material tube therein. It can be appreciated that different sized tubes 172 and pistons 170 can be utilized for different sized chub packs 2 or for different applications.

The chub pack 2 may be inserted through the opened second end of the material chamber section 160 and consequently received in the tube 172. The opened second end of the material chamber section 160 may have a diameter less than a diameter of the remaining portion of the material chamber section 160, thereby creating an inwardly extending ledge. The ledge may be configured to contact an end of the tube 172 inserted therein, thereby securing it in place.

The cap 174 includes interior threads or other engaging means that correspond with the exterior threads or engaging means of the opened second end of the material chamber section 160 for securing the cap 174 thereto. The cap 174 includes an opening having a configuration capable of receiving the dispensing end 88 of the nozzle tip 70 or a nozzle of a material tube therethrough. The ledge 76 of the cap 70 has a configuration capable of abutting against an internal edge of the cap 174 that in part defines the opening of the cap 174. The ledge 76 prevents the nozzle tip 70 from being pushed through and out the cap 174.

The nozzle tip 70 can have a configuration capable of receiving an end portion of the chub pack 2. It can be appreciated that the nozzle tip 70 can be integrally formed with the cap 174, thereby creating a single cap and nozzle tip unit.

It can be appreciated that after the chub pack 2 is inserted into the tube 172, the nozzle tip 70 is received in the opened second end of the material chamber section 160 by securing the cap 174 to the opened second end so that the dispensing end 88 extends through the opening of the cap 174. Advancement of the piston rod 162 results in the piston 170 contacting an end of the chub pack 2, which in turn results in the other end of the chub pack 2 to be pressed against the piercing projections 80 thereby puncturing the chub pack 2. Once the chub pack 2 is punctured by the piercing projections 80, the piercing projections 80 are inserted/received into the interior of the chub pack 2 so that any material in the chub pack 2 is allowed to flow through the channel 84 and into hollow interior of the nozzle tip 70, and then into the dispensing end 88. Continued advancement of the piston rod 162 results in material being dispensed out of the chub pack 2 and through the nozzle tip 70.

It can now be understood that the material dispensing system 100 of the present technology can be used to dispense a material, such as but not limited, caulk, adhesive, sealant, paste, cement and the like, from a chub pack 2 or prefilled material tube. In exemplary use, with the piston rod 162 fully retracted, a user can install the tube 172 into the material chamber section 160 and then insert the chub pack 2 tube 172 or install the chub pack 2 into the tube 172 and then insert the tube 172 and chub pack 2 into the material chamber section 160. The nozzle tip 70 can then be inserted through the opened second end of the material chamber section 160 and secured in place by securing the cap 174 to the opened second end of the material chamber section 160.

The user can then operate the trigger 112, which in turn operates the motor 122, which in turn provides torque to the planetary gears 125 and sun gears 126 assembly.

Simultaneously with depression of the trigger 112 and operation of the motor 122, the trigger 112 moves the lock block 128 so that its detent 129 is received in one of the notches 131 of the ring gear 130, thereby preventing the ring gear 130 from rotation, which in turn allows torque from the planetary gears 125 and sun gears 126 assembly to transfer to the spindle 136. Torque from the spindle 136 is consequently transferred to the bevel pinion gear 142 and then to the bevel gear 146, which in turn rotates the translation gear section 148. Rotation of the translation gear section 148 transfers the torque to linear movement of the rack 164 of the piston rod 162, which in turn advances the piston rod 162 which advances the piston 170 toward the end of the chub pack 2.

The advancement of the piston 170 pushes the other end of the chub pack 2 against the piercing projections 80 so that the piercing end 82 punctures through the end of the chub pack 2, thereby opening a passage between the interior of the chub pack 2 and the hollowing interior of the nozzle tip 70. Material from the chub pack 2 is then dispensed through the dispensing end 88 as long as the trigger is depressed. The user can adjust the speed or torque of the motor 122 by operating the dial 152.

To cease the dispensing of material, the user would release the trigger 112, which in turn stop operation of the motor 122 and slides the lock block 128 out of engagement with the ring gear 130, thereby allowing the ring gear 130 to rotate freely and immediately avoiding unwanted dispensing of material.

While embodiments of the material dispensing system have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although controllably dispensing material from a chub pack have been described, it should be appreciated that the material dispensing system herein described is also suitable for dispensing any material stored in a packaging or container by piercing the packaging using advancing pressure supplied by a moving piston.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A material dispensing system comprising:

a housing having a configuration capable of receiving a packaging containing a material therein;

at least one nozzle tip associated with said housing, said nozzle tip including at least one piercing projection configured to pierce the packaging and allowing the material in the packaging to be dispensed from said nozzle tip;

at least one piston rod at least partially slidably received in said housing, said piston rod having a configuration capable of compressing the packaging toward said piercing projection;

at least one motor;

a transmission assembly selectively operably coupling an output of said motor and said piston rod for powered translation of said piston rod in at least one of a forward direction and a reverse direction, said transmission assembly including a ring gear, and a lock block moveable to operably engage with said ring gear to prevent said ring gear from rotating, said transmission assembly including at least one planetary gear operably engageable with at least one sun gear; and a gearbox configured to receive said ring gear and said lock block, said gearbox defining a channel configured to slidable receive said lock block;

wherein an axis of rotation of said sun gear is parallel with a longitudinal axis of said piston rod.

2. The material dispensing system of claim 1, wherein said ring gear receiving and operably engageable with said planetary gear.

3. The material dispensing system of claim 2, wherein said ring gear defines multiple radially arranged notches, and said lock block includes a detent configured to be receivable in at least one of said notches when said lock block is moved in an engagement position upon depression of a trigger.

4. The material dispensing system of claim 3, wherein said trigger includes an extension that is received in a slot defined in said lock block.

5. The material dispensing system of claim 4, wherein said gearbox is configured to receive said planetary gear, said sun gear, said ring gear and said lock block.

6. The material dispensing system of claim 5 further comprises a gearbox cover connectable to said gearbox for enclosing at least said planetary gear, said sun gear and said ring gear between said gearbox cover and said gearbox, wherein a portion of said sun gear extends out past said gearbox cover and is operably engageable with a bevel gear exterior of said gearbox and said gearbox cover, said bevel gear is operably engageable with a rack of said piston rod and is configured for converting rotational output of said sun gear to the translational output of said piston rod.

7. The material dispensing system of claim 6, wherein said portion of said sun gear and a first portion of said bevel gear are enclosed within a transmission housing that is connectable to said gearbox cover, and wherein a second portion of said bevel gear is exterior of said transmission housing and is operable engageable with said rack of said piston rod.

8. The material dispensing system of claim 2, wherein said planetary gear and said sun gear is a plurality of successive planetary gear and sun gear stages, an initial of said planetary gear is operable engageable with said output of said motor, and a final of said planetary gear is operable engageable with said ring gear.

9. The material dispensing system of claim 8, wherein said final of said planetary gear is operable engageable with a spindle including a bevel pinion gear, and said bevel pinion gear is operably engageable with a bevel gear, said bevel gear is operably engageable with a rack of said piston rod and is configured for converting rotational output of said spindle to the translational output of said piston rod.

10. The material dispensing system of claim 1, wherein said sun gear is operably engageable with a bevel gear configured to be operably engageable with a rack of said piston rod and for converting rotational output of said sun gear to the translational output of said piston rod.

11. The material dispensing system of claim 1 further comprising a tube configured to receive the packaging and a piston associated with said piston rod, said tube is positioned in said housing with one end of said tube adjacent said nozzle tip.

12. The material dispensing system of claim 1, wherein said piston rod includes a longitudinal flat surface slidably engageable with an interior wall of said housing, said longitudinal flat surface or said interior wall is configured to prevent said piston rod from rotating.

13. The material dispensing system of claim 1, wherein said piercing projection further includes a piercing end, and an interior side defining at least one channel in said interior side and along a longitudinal axis of said piercing projection, said channel being in fluid communication with a hollow interior of a dispensing end of said nozzle tip.

14. The material dispensing system of claim 13, wherein said piercing projection further includes an exterior side angled from a longitudinal axis of said nozzle tip, and wherein said interior side is parallel with said longitudinal axis of said nozzle tip.

15. A material dispensing system comprising:

a housing having a configuration capable of receiving a packaging containing a material therein;

at least one piston rod at least partially slidably received in said housing, said piston rod having a configuration capable of compressing the packaging;

at least one motor;

at least one planetary gear operably engageable with at least one sun gear, said planetary gear being operably coupled with an output of said motor, said sun gear being selectively operably coupled with said piston rod for powered translation of said piston rod in at least one of a forward direction and a reverse direction;

a ring gear configured to receive and operably engageable with said planetary gear, said ring gear defining multiple radially arranged notches;

a trigger includes an extension that is received in a slot defined in said lock block;

a lock block moveable to operably engage with said ring gear to prevent said ring gear from rotating, said lock block including a detent configured to be receivable in at least one of said notches when said lock block is moved in an engagement position upon depression of said trigger; and a gearbox configured to receive said planetary gear, said sun gear, said ring gear and said lock block, said gearbox defining a channel configured to slidable receive said lock block;

wherein an axis of rotation of said sun gear is parallel with a longitudinal axis of said piston rod.

16. The material dispensing system of claim 15 further comprises at least one nozzle tip associated with said housing, said nozzle tip includes at least one piercing projection having a configuration capable of piercing the packaging and allowing the material in the packaging to be dispensed from said nozzle tip.

17. The material dispensing system of claim 15 further comprises a bevel gear operably engageable with an output of said planetary gear or said sun gear, said bevel gear is operably engageable with a rack of said piston rod and is configured for converting torque from said output to the translational output of said piston rod.

* * * * *